US010539130B2

(12) United States Patent
Frick et al.

(10) Patent No.: US 10,539,130 B2
(45) Date of Patent: Jan. 21, 2020

(54) PRESSURE-MAINTAINING VALVE ARRANGEMENT FOR A PURGE CIRCUIT OF A CLOSED HYDRAULIC CIRCUIT

(71) Applicant: Robert Bosch GmbH, Stuttgart (DE)

(72) Inventors: Christian Frick, Laupheim (DE); Hakan Camurdan, Neu-Ulm (DE); Markus Gepraegs, Ulm (DE); Stephan Rohde, Elchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/445,950

(22) Filed: Feb. 28, 2017

(65) Prior Publication Data

US 2017/0306946 A1 Oct. 26, 2017

(30) Foreign Application Priority Data

Apr. 26, 2016 (DE) ..... 10 2016 207 003

(51) Int. Cl.
*F04B 49/22* (2006.01)
*F04B 9/117* (2006.01)
*F04B 15/02* (2006.01)

(52) U.S. Cl.
CPC ..... *F04B 49/22* (2013.01); *F04B 9/117* (2013.01); *F04B 15/02* (2013.01); *Y10T 137/86702* (2015.04)

(58) Field of Classification Search
CPC .... F16K 3/246; F16K 11/044; F16K 31/1221; Y10T 137/86582; Y10T 137/86702;
(Continued)

(56) References Cited

U.S. PATENT DOCUMENTS 3,618,984 A * 11/1971 Cook ..... B62D 49/0642 280/431
5,771,931 A * 6/1998 Watson ..... E21B 33/0355 137/236.1

(Continued)

FOREIGN PATENT DOCUMENTS

DE 195 42 258 A1 5/1997
DE 10 2005 008 217 A1 8/2006
DE 10 2008 060 066 A1 6/2010

OTHER PUBLICATIONS

Translation of DE 102008060066.*

*Primary Examiner* — Kevin F Murphy
*Assistant Examiner* — Kelsey E Cary
(74) *Attorney, Agent, or Firm* — Maginot, Moore & Beck LLP

(57) ABSTRACT

A pressure-maintaining valve arrangement of a purge circuit of a closed hydraulic circuit includes a pressure-maintaining valve configured to be shut off via a pilot valve. In one embodiment, a control pressure chamber, acting in the closing direction, of the pressure-maintaining valve is configured to be relieved via the pilot valve to a tank, and the pressure-maintaining valve is closed via a spring acting in the closing direction. In another embodiment, the valve arrangement includes an additional control pressure chamber acting in the closing direction. The additional control pressure chamber is configured to be loaded via the pilot valve, and the pressure-maintaining valve closes. The pressure of the inlet of the pressure-maintaining valve is used for this purpose.

14 Claims, 3 Drawing Sheets

(58) Field of Classification Search
CPC .... Y10T 137/8671; F04B 49/22; F04B 9/117; F04B 15/02
USPC ..... 137/625.6, 625.68, 625.69
See application file for complete search history.

(56) References Cited

U.S. PATENT DOCUMENTS

| | | | | |
|---|---|---|---|---|
| 8,397,758 | B2 * | 3/2013 | Hillesheim | G05D 16/2093 137/625.64 |
| 2007/0169826 | A1 * | 7/2007 | Hillesheim | G05D 16/2093 137/625.64 |
| 2011/0240897 | A1 * | 10/2011 | Gepraegs | F15B 13/024 251/282 |
| 2013/0081725 | A1 * | 4/2013 | Arisato | F15B 13/028 137/625.6 |

* cited by examiner

PRESSURE-MAINTAINING VALVE ARRANGEMENT FOR A PURGE CIRCUIT OF A CLOSED HYDRAULIC CIRCUIT

This application claims priority under 35 U.S.C. § 119 to patent application no. DE 10 2016 207 003.7, filed on Apr. 26, 2016 in Germany, the disclosure of which is incorporated herein by reference in its entirety.

BACKGROUND

The disclosure relates to a pressure-maintaining valve in the purge circuit of a closed hydraulic circuit.

Document DE 195 42 258 A1 shows a closed hydraulic circuit, via the two working lines of which a two-cylinder thick material pump (concrete pump) is supplied. The two working lines are alternately connectable via what is referred to as a purge valve to a purge line leading to the tank. In more precise terms, the respective working line conducting low pressure is connected to the tank via the purge valve. In order to ensure a minimum pressure in the purge line, a pressure-maintaining valve is provided therein.

Since the two cylinders of the thick material pump have to be supplied via the closed circuit in a differential mode, the variable displacement pump of the closed circuit is periodically fully pivoted. As a result, a corresponding periodic change between high pressure and low pressure arises in the two working lines. The pressure on the low pressure side may severely breakdown here and thus damage the variable displacement pump.

Document DE 10 2005 008 217 A1 likewise shows a closed circuit, the two working lines of which are alternately connectable via a purge valve to a purge line leading to the tank, wherein a pressure-maintaining valve is arranged in the purge line. Pressure drops in the respective working line conducting low pressure are intended to be prevented by the fact that, during the change-over operations of the variable displacement pump, the purge flow from the working line conducting low pressure through the purge line is briefly interrupted. In first exemplary embodiments, a directional control valve which is brought into a blocking position is provided for this purpose in series with the purge valve and with the pressure-maintaining valve. The comparatively large volumetric flow for which the additional directional control valve has to be designed is a disadvantage thereof. In a second exemplary embodiment, the control chambers on the purge valve are relieved via pilot valves to the tank, and therefore the purge valve passes into its central position and shuts off the purge flow.

According to document DE 10 2008 060 066 A1, a control chamber is provided on the spring side of the pressure-maintaining valve of the purge line, said control chamber being able to be acted upon with the pressure of an external pressure source in order thereby to shut the pressure-maintaining valve and to shut off the purge flow. The outlay in terms of device for the shut-off function of the pressure-maintaining valve is a disadvantage thereof.

By contrast, the disclosure is based on the object of providing a pressure-maintaining valve arrangement which can be switched off or can be shut off for a purge circuit of a closed hydraulic circuit in which the outlay in terms of device is reduced.

SUMMARY

This object is achieved by a pressure-maintaining valve arrangement with the features of the disclosure.

The pressure-maintaining valve arrangement according to the disclosure is inserted into a purge circuit or a purge device of a closed hydraulic circuit. A pressure-maintaining valve has a valve body which can be acted upon or is permanently acted upon in the closing direction by the force of a—preferably adjustable—spring and in the opening direction by the inlet pressure tapped off upstream of the pressure-maintaining valve. According to the disclosure, for this purpose, a control surface on the valve body of the pressure-maintaining valve is acted upon by the inlet pressure in a first position of a valve body of a pilot valve. The control surface on the valve body of the pressure-maintaining valve is relieved to a tank connection of the pressure-maintaining valve, which tank connection is connectable to a tank, in a second position of the valve body of the pilot valve.

The control space preferably bounds a control pressure chamber which is connected via a channel to an outlet of the pilot valve.

Further advantageous refinements of the disclosure are described in the dependent claims.

If a valve housing of the pressure-maintaining valve is designed as a screw-in cartridge, it can be screwed into a primary housing. The inlet or an approximately annular inlet pressure chamber can be arranged on the outer circumference of the screw-in cartridge, while a tank connection is arranged on a first end side of the screw-in cartridge, which end side can be inserted or introduced into the primary housing. A cover is fastened to a second end side of the screw-in cartridge, in or on which the pilot valve is arranged.

If a valve housing of the pilot valve is also designed as a screw-in cartridge, it can be screwed into the cover. An inlet of the pilot valve is arranged on the outer circumference of its screw-in cartridge, and an approximately annular inlet pressure chamber of the pilot valve is formed in the cover, while the outlet of the pilot valve is arranged on an end side of its screw-in cartridge, said end side being inserted or introduced into the cover, and is formed in the cover.

An approximately annular outer inlet pressure chamber can be formed on the outer circumference of the screw-in cartridge of the pressure-maintaining valve and in the primary housing and is connected via an inlet channel to the inlet of the pilot valve. A first portion of the inlet channel can be arranged in the screw-in cartridge of the pressure-maintaining valve and a second portion of the inlet channel can be arranged in the cover.

An approximately annular tank pressure chamber of the pilot valve, which tank pressure chamber is formed in the cover, can be arranged on the outer circumference of the screw-in cartridge of the pilot valve and is connected to a tank pressure chamber of the pressure-maintaining valve via a tank channel of the cover.

In a preferred development of the pressure-maintaining valve arrangement according to the disclosure, the valve body of the pressure-maintaining valve is penetrated by a—preferably concentric—through channel which connects the tank connection of the pressure-maintaining valve to the tank pressure chamber of the pressure-maintaining valve.

The spring of the pressure-maintaining valve is tensioned preferably via a spring plate against a tank-connection-side end side of the valve body of the pressure-maintaining valve. The spring plate is also penetrated by a—preferably concentric—through channel which communicates with the through channel of the valve body and in which a nozzle is formed.

The tank pressure chamber of the pressure-maintaining valve is arranged between a cover-side end side of the valve body of the pressure-maintaining valve, which end side is opposite the tank-connection-side end side, and the cover. The tank pressure chamber is connected to a tank connection of the pilot valve.

For the tilt-free guidance of the valve body of the pressure-maintaining valve in its valve housing or its screw-in cartridge, a piston collar can be formed on the valve body of the pressure-maintaining valve, via which piston collar the valve body is guided in a valve bore of the pressure-maintaining valve.

The closure according to the disclosure of the pressure-maintaining valve takes place in a particularly tight manner if the valve body of the pressure-maintaining valve has a conical closing portion which can be tensioned against a valve seat of the pressure-maintaining valve via the spring of the pressure-maintaining valve. A radial constriction can be formed between the closing portion and the piston collar, said constriction forming an approximately annular, inner, pressure-equalized inlet pressure chamber in the interior of the valve housing of the pressure-maintaining valve. In the case of the screw-in housing, the valve seat and the inlet pressure chamber are formed therein.

The outer inlet pressure chamber is connected to the inner inlet pressure chamber via at least one radial bore—preferably via a star-shaped radial bore.

It is straightforward in terms of device if the pilot valve is configured as a 3/2-way directional control switching valve.

According to a first variant of the pressure-maintaining valve arrangement according to the disclosure, the control surface which is switchable according to the disclosure acts in the opening direction of the valve body of the pressure-maintaining valve and therefore counter to the spring. The first position of the valve body of the pilot valve permits a normal function of the pressure-maintaining valve arrangement, and the second position of the valve body of the pilot valve permits a shut-off function of the pressure-maintaining valve arrangement. It is therefore possible to switch the normal function and the shut-off function via a common control surface on the valve body of the pressure-maintaining valve.

For structural reasons, the channel in the valve housing can have an oblique portion. In the case of the screw-in housing, the oblique portion is formed in the latter.

For reasons of stability against vibrations of the valve piston, the channel preferably has a nozzle.

In the first variant, it is furthermore preferred if the valve body of the pilot valve is pretensioned into the first position via a spring of the pilot valve, and if the valve body of the pilot valve is movable into the second position via an actuator. The pressure-maintaining valve arrangement is therefore currentless in normal function.

According to a second variant of the pressure-maintaining valve arrangement according to the disclosure, the control surface interacts with the spring in the closing direction of the valve body of the pressure-maintaining valve. The first position of the valve body of the pilot valve permits a shut-off function of the pressure-maintaining valve arrangement, and the second position of the valve body of the pilot valve permits a normal function of the pressure-maintaining valve arrangement.

Two control surfaces are provided here on the valve body of the pressure-maintaining valve, of which the control surface which is switchable acts in the closing direction while a further control surface (known per se from the prior art) acts permanently in the opening direction.

The tank pressure chamber of the pressure-maintaining valve can be bounded by a piston ring which is placed onto the valve body of the pressure-maintaining valve, on the side of which piston ring opposite the tank pressure chamber the control surface which acts in the closing direction and is switchable is formed.

The control surface (which is known per se from the prior art) acting permanently in the opening direction is formed on the piston collar which is permanently connected to the inner inlet pressure chamber for example via flattened portions of the piston collar.

In the second variant, it is preferred if the valve body of the pilot valve is pretensioned with a spring into the second position, and if the valve body of the pilot valve is movable into the first position with an actuator. The pressure-maintaining valve arrangement is therefore currentless in normal function.

In both variants, the actuator is preferably electrical, and therefore the pressure-maintaining valve can be switched off or shut off by an electric switching over of the pilot valve, and therefore the critical pressure drop in the working line conducting low pressure is avoided.

The purge device or the purge circuit is provided for a closed hydraulic circuit. The purge device or the purge circuit has a purge valve via which the two working lines of the circuit are connectable to the inlet of a previously described pressure-maintaining valve arrangement. The pressure of the inlet of the pressure-maintaining valve is then tapped off between the purge valve and the pressure-maintaining valve.

The closed hydraulic circuit according to the disclosure has two working lines to which a purge valve of an aforementioned purge device or of a previously described purge circuit is connected. A variable displacement pump is preferably provided, i.e. a pump which is adjustable in its swept volume and is adjustable via zero in order thereby to produce changing conveying directions and changing pressure sides of the pressure medium in the working lines. In the case of an axial piston pump, the latter can be fully pivoted.

BRIEF DESCRIPTION OF THE DRAWINGS

A plurality of exemplary embodiments of a pressure-maintaining valve arrangement according to the disclosure in the purge circuit of a closed hydraulic circuit are illustrated in the drawings. The disclosure is now explained in more detail with reference to the figures of said drawings, in which.

DETAILED DESCRIPTION

Figure 1:
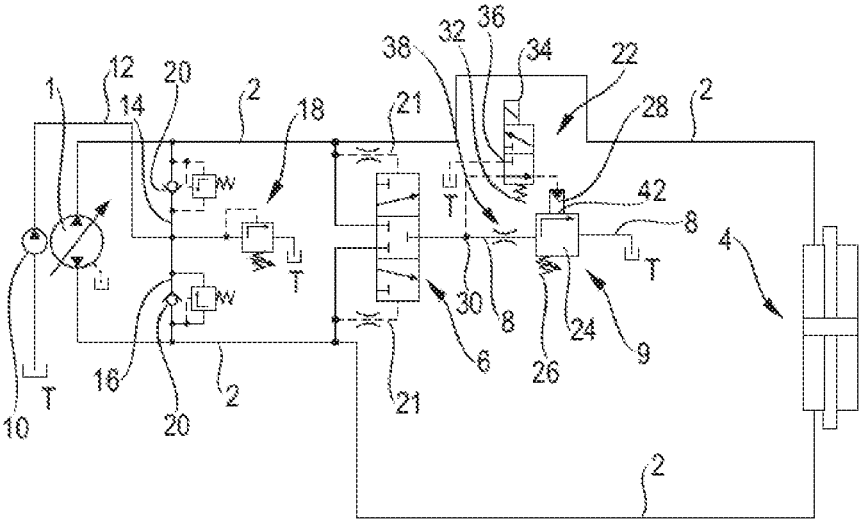
FIG. 1 shows a circuit diagram of a closed hydraulic circuit with a pressure-maintaining valve arrangement according to a first exemplary embodiment.

FIG. 1 shows a circuit diagram of a closed hydraulic circuit with a fully pivotable variable displacement pump 1 with which its swept volume and its conveying direction are adjustable. The variable displacement pump has two working lines 2, a hydraulic motor which is designed here as a synchronizing cylinder 4 and drives a two-cylinder thick material pump which serves as a concrete pump. Of course, the hydraulic motor may also be a rotary drive.

Figure 4:
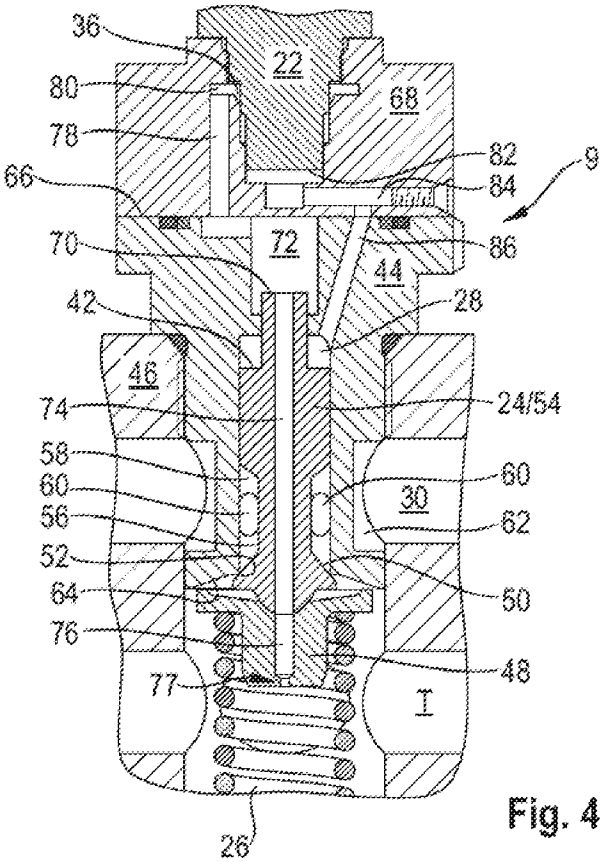
FIG. 4 shows a further partial longitudinal section of the first exemplary embodiment of the pressure-maintaining valve arrangement according to the disclosure from FIG. 1.
Figure 3:
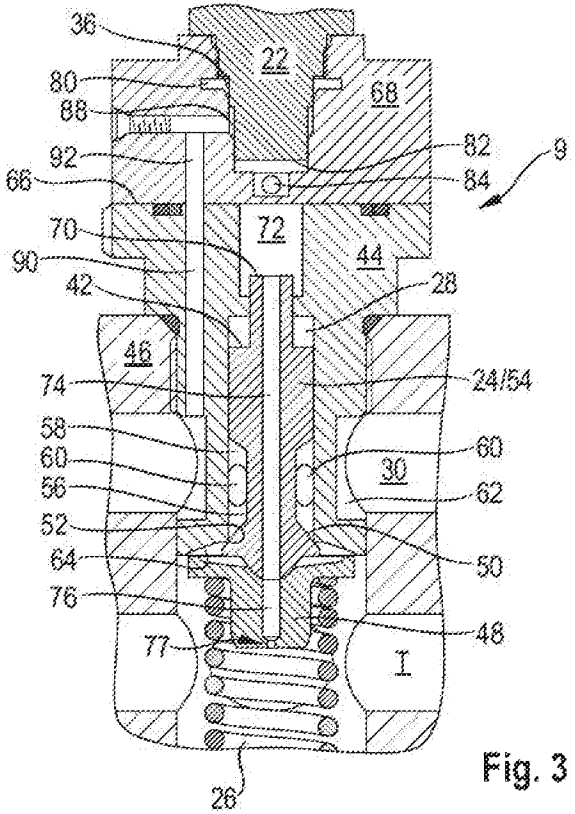
FIG. 3 shows a partial longitudinal section of the first exemplary embodiment of the pressure-maintaining valve arrangement according to the disclosure from FIG. 1.

The two working lines 2 are connected to a respective inlet of a purge valve 6 which is designed as a 3/3-way directional control valve and the outlet of which is connected to a tank T via a purge line 8. A pressure-maintaining valve 9 which is explained more accurately with respect to FIGS. 3 and 4 is provided in the purge line 8.

A feed pump 10 conveys pressure medium which it sucks up out of the tank T into a feed line 12 which branches into two feed line portions 14, 16. Each feed line portion 14, 16 contains a nonreturn valve 20 which opens in the direction from the feed line 12 to a working line 2 and via which pressure medium can flow into a working line 2, and a high pressure limiting valve which is arranged parallel to the nonreturn valve 20 and protects the corresponding working line. The feed line 12 and the feed line portions 14, 16 are protected with respect to the tank T via a pressure-limiting valve 18.

During the operation of the closed hydraulic circuit which is shown, the variable displacement pump 1 is periodically fully pivoted, and therefore the synchronizing cylinder 4 is periodically alternately supplied with pressure medium. The purge valve 6 is configured here in such a manner that the working line 2 conducting low pressure is always connected to the purge line 8 and therefore to the tank T. For this purpose, use is made of two control lines 21 which are connected to a respective working line 2 and which correspondingly adjust a valve body of the purge valve 6. The amount of pressure medium removed via the purge circuit or via the purge device 6, 8, 9 is supplemented via the feed pump 10, the feed line 12, the feed line portion 14, 16 correspondingly leading to the low pressure and via the nonreturn valve 20 thereof which opens with respect to the working line 2.

A pressure-maintaining valve 9 is arranged in the purge line 8. A nozzle 38 is arranged in the purge line 8 between said pressure-maintaining valve and the purge valve 6.

The low pressure in the corresponding working line 2 may break down sharply because of the periodic change between high pressure and low pressure. These pressure drops may damage the variable displacement pump 1. The working line 2 conducting pressure medium removal from the low pressure is therefore temporarily interrupted via the purge circuit or via the purge device 6, 8, 9. For this purpose, use is made of the pressure-maintaining valve 9 which may also be called the main valve and which is assigned a pilot valve 22. Main valve and pilot valve together form the pressure-maintaining valve arrangement according to the disclosure. The pressure-maintaining valve 9 is designed here with a movable valve body 24 which is pretensioned in the closing direction by an adjustable spring 26. The spring force is counteracted by the pressure which prevails in the opening direction in a control pressure chamber 28 on the side remote from the spring, wherein the control pressure chamber 28 is bounded by a control surface 42 of the valve body 24. The control pressure chamber is connectable to the purge line 8 at an inlet 30 upstream of the nozzle 38 and can therefore be acted upon with the pressure upstream of the nozzle 38. This pressure corresponds to the pressure in the working line 2 conducting low pressure. In known pressure-maintaining valves, this connection is permanent, and therefore the pressure-maintaining valve switches and is on or off depending on the pressure present at the inlet 30.

So that the pressure-maintaining valve 9 can be kept closed even when the pressure at the inlet 30 is sufficiently high in order to open the pressure-maintaining valve, the pilot valve 22 is provided. There is a connection between the inlet 30 and the control pressure chamber 28 only when a valve body of the pilot valve 22 is switched into its basic position by a spring 32 of the pilot valve 22. If, by contrast, the valve body of the pilot valve 22 is switched over via an electric actuator 34 of said pilot valve 22, the control pressure chamber 28 of the pressure-maintaining valve 9 is connected to a tank connection 36 of the pilot valve and is therefore relieved to the tank T. The force of the spring 26 of the pressure-maintaining valve 9 is then the only significant force on the valve body 24 of the pressure-maintaining valve 9, and therefore the latter is closed. The connection of the working line 2, which conducts low pressure, of the hydraulic circuit to the tank T is therefore transitionally shut off, and therefore a pressure drop in the respective working line 2 is prevented.

Since the pressure-maintaining valve arrangement is provided in the common purge line 8 downstream of the purge valve 6, a single pressure-maintaining valve arrangement is necessary. Since only small amounts of control pressure medium flow through the pilot valve 22, the latter can be of correspondingly small and cost-effective design. When the pressure-maintaining valve is open, the purge amount flowing away out of the working line, conducting the low pressure, via the purge valve 6, the nozzle 38 and the pressure-maintaining valve 9 to the tank is determined by the nozzle 38. Said purge amount arises from the pressure drop via the nozzle 38, said pressure drop corresponding to that in the working line 2 conducting the low pressure, and from the flow cross section of the nozzle 38. If large purge oil amounts are desired, the nozzle 38 can be dispensed with. The pressure drop from the pressure prevailing in the working line 2 conducting the low pressure to the pressure set at the pressure-maintaining valve 9 then takes place via the purge valve 6.

A nozzle through which the tendency of the pressure-maintaining valve 9 to vibrate is reduced can be arranged in the line portion between the pilot valve 22 and the control pressure chamber 28.

Instead of the pilot valve 22 which is designed as a 3/2-way directional control valve and by means of which a two-edge control is realized, the pressurization of the control pressure chamber 28 can also be controlled by a single-edge control. A 2/2-way directional control valve and a nozzle are then arranged in series with each other in a control line starting from the inlet 30 and leading to a tank. The pressure for the control pressure chamber is tapped off between the 2/2-way directional control valve and the nozzle.

Figure 2:
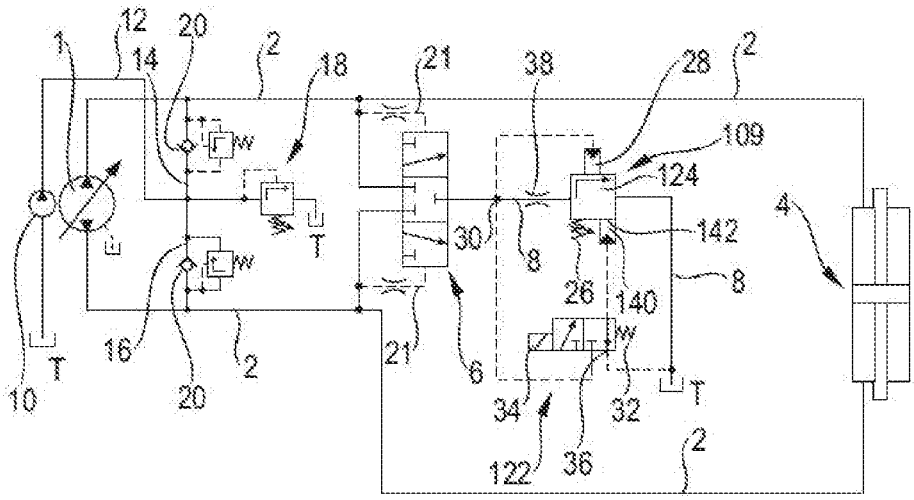
FIG. 2 shows a circuit diagram of a closed hydraulic circuit with a pressure-maintaining valve arrangement according to second exemplary embodiment.

FIG. 2 shows a circuit diagram of a closed hydraulic circuit which corresponds to that according to FIG. 1 except for the design of the pressure-maintaining valve. Only the differences over the first exemplary embodiment will be described below. The pressure-maintaining valve 109 according to FIG. 2 has, in addition to the control pressure chamber 28 remote from the spring, a further control pressure chamber 140 which acts together with the adjustable spring 26 in the closing direction of the valve body 124 of the pressure-maintaining valve 109. The control pressure chamber 28 acting in the opening direction is permanently connected to the inlet 30 of the pressure-maintaining valve 9.

The pilot valve 122 is designed in turn as a 3/2-way switching directional control valve and, in its basic position which is pretensioned by its spring 32 and is shown in FIG. 2, relieves the control pressure chamber 140 to the tank connection 36 of the pilot valve 122 and therefore to the tank T. In its switching position switchable by the actuator 34, the pilot valve 122 connects the inlet 30 of the pressure-maintaining valve 9 to the control pressure chamber 140. Since the control surface 142 of the control pressure chamber 140 is at least exactly the same size as that of the control pressure chamber 28 and since the control pressure chamber 140 acts together with the spring 26 in the closing direction, the pressure-maintaining valve 109 closes in the switching position of the pilot valve 122 that is switched by the actuator, and therefore the pressure drop in the working line 2 conducting low pressure is prevented. If the pilot valve 122 is in its basic position, the control pressure chamber 140 is relieved to the tank, and therefore the pressure-maintaining valve operates solely depending on the pressure at the inlet 30 which is connected via a control line to the control pressure chamber 28.

Precisely as in the exemplary embodiment according to FIG. 1, in the exemplary embodiment according to FIG. 2, too, instead of the pilot valve 122 which is designed as a 3/2-way directional control valve and by means of which a two-edge control is realized, the pressurization of the pressure control chamber 140 can also be controlled by a single-edge control. A 2/2-way directional control valve and a nozzle are then arranged in series with one another in a control line starting from the inlet 30 and leading to a tank. The pressure for the control pressure chamber is tapped off between the 2/2-way directional control valve and the nozzle.

If large purge oil amounts are desired in the exemplary embodiment according to FIG. 2, the nozzle 38 can be dispensed with. The pressure drop from the pressure prevailing in the working line 2 conducting low pressure to the pressure set at the pressure-maintaining valve 9 then takes place via the purge valve 6.

A nozzle through which the inclination of the pressure-maintaining valve 9 to vibrate is reduced can be arranged in the line portion between the inlet 30 and the control pressure chamber 28.

FIGS. 3 and 4 show the pressure-maintaining valve arrangement with the pressure-maintaining valve 9 and the pilot valve 22 according to the first exemplary embodiment in two different longitudinal sections, but without the nozzle 38 which is shown in FIG. 1. The pressure-maintaining valve 9 has a valve housing which is designed as a screw-in cartridge 44, and therefore it can be screwed into a primary housing 46. The spring 26 of the pressure-maintaining valve 9 is also tensioned here and is supported on the primary housing 46 at a structure (not shown). The spring 26 tensions a conical closing portion 50 of the valve body 24 against a valve seat 52 of the screw-in cartridge 44 via a spring plate 48.

Furthermore, the valve body 24 of the pressure-maintaining valve 9 has a piston collar 54 serving as a guide portion. Between the piston collar 54 and the closing portion 50 there is a neck 56 via which an inner inlet pressure chamber 58 is formed and bounded. The latter is pressure-equalized and is connected to the inlet 30 of the pressure-maintaining valve 9 via a star-shaped radial bore, of which only two radial bores 60 are visible. Put more precisely, formed on the outer circumference of the screw-in cartridge 44 is an annular outer inlet pressure chamber 62 between the screw-in cartridge 44 and the primary housing 46, to which inlet pressure chamber the inner inlet pressure chamber 58 is connected via the star-shaped radial bore.

The annular end-side control pressure chamber 28 which acts counter to the force of the spring 26 in the opening direction is arranged on that side of the piston collar 54 which faces away from the inner inlet pressure chamber 58 and can be pressurized and can be relieved of pressure via the pilot valve 22.

The valve seat 52 is formed, and the spring plate 48 and the spring 26, and the tank connection T of the pressure-maintaining valve 9 are arranged, on a first end side 64 of the screw-in cartridge 44 of the pressure-maintaining valve 9, which screw-in cartridge is screwed into the primary housing 46. A cover 68 to which the pilot valve 22 is fastened is fastened to a second end side 66 of the screw-in cartridge 44. In particular, a valve housing of the pilot valve 22 is likewise configured as a screw-in cartridge and is screwed into the cover 68.

Between the cover 68 and a cover-side end side 70 of the valve body 24 of the pressure-maintaining valve 9, a tank pressure chamber 72 is formed in the screw-in cartridge 44, said tank pressure chamber being connected to the tank connection T of the pressure-maintaining valve 9 via a concentric through channel 74 of the valve body 24 and via a concentric through channel 76 of the spring plate 48 and via a nozzle 77 formed therein.

It is illustrated in FIG. 4 that the tank pressure chamber 72 of the pressure-maintaining valve 9 is connected to the tank connection 36 of the pilot valve 22 via a tank channel 78 formed in the cover 68 and via a tank chamber 80 formed in the cover 68.

It is furthermore illustrated in FIG. 4 that an outlet 82 of the pilot valve 22, which outlet is arranged on the end side of the screw-in cartridge of the latter, is connected via a channel to the control pressure chamber 28, which is switchable according to the disclosure, of the pressure-maintaining valve 9. For this purpose, a radial channel portion 84 is provided in the cover 68 and an oblique channel portion 86 is provided in the screw-in cartridge 44 of the pressure-maintaining valve 9. Via said channels 84, 86, the control pressure chamber 28 which is switchable according to the disclosure is either relieved to the tank chamber 80 of the pilot valve 22 or is acted upon by the pressure of the inlet 30 of the pressure-maintaining valve 9 depending on the switching position of the pilot valve 22.

It is illustrated in FIG. 3 that the outer inlet pressure chamber 62 of the pressure-maintaining valve 9 is connected to an inlet 88 of the pilot valve via an inlet channel. The inlet channel has a first channel portion 90 in the screw-in cartridge 44 and a second channel portion 92 in the cover 68.

A nozzle which is possibly to be provided between the outlet 82 of the pilot valve 22 and the control pressure chamber 28 can be screwed into the channel portion 84 or into the channel portion 86 or can be realized directly as a narrow point in one of the channel portions by drilling.

Figure 6:
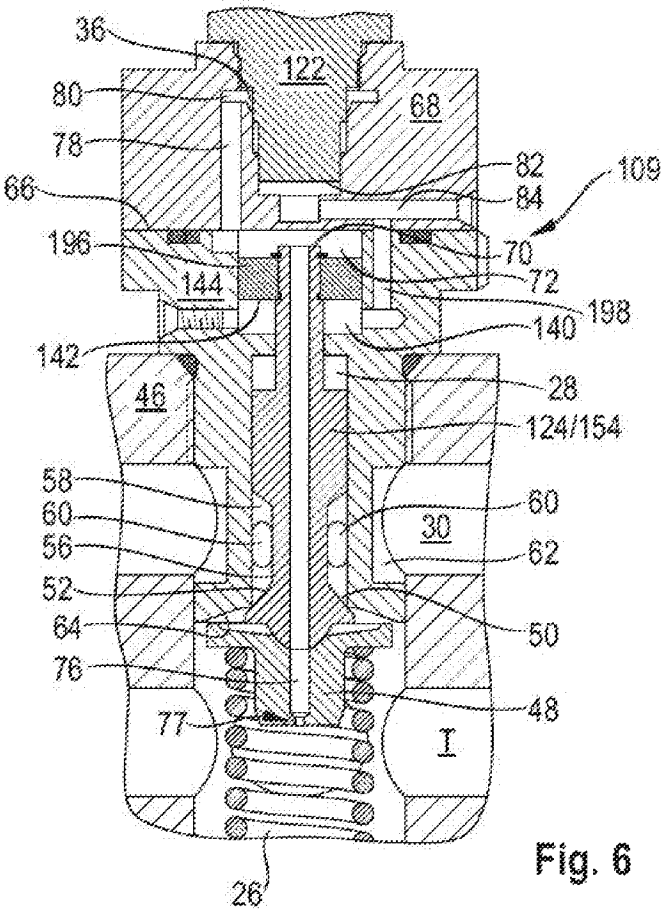
FIG. 6 shows a further partial longitudinal section of the second exemplary embodiment of the pressure-maintaining valve arrangement according to the disclosure from FIG. 2.
Figure 5:
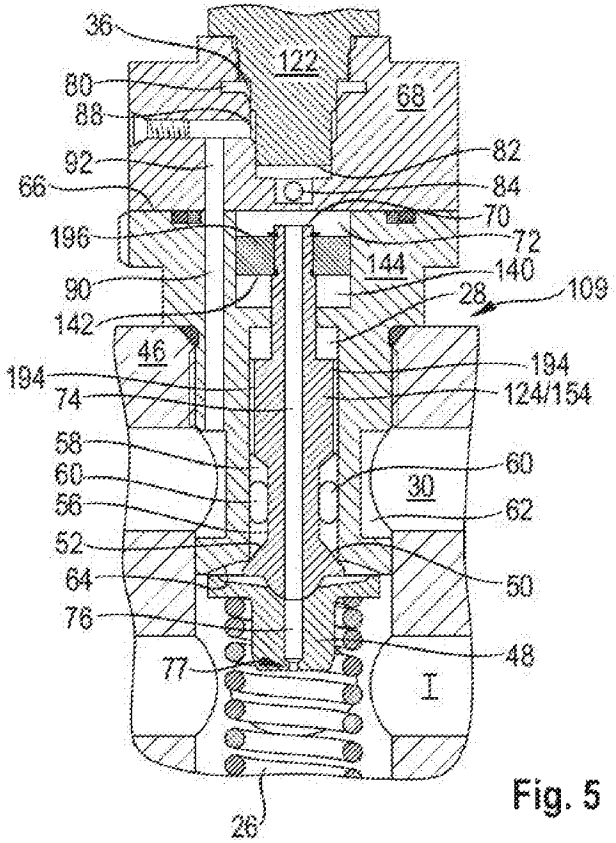
FIG. 5 shows a partial longitudinal section of the second exemplary embodiment of the pressure-maintaining valve arrangement according to the disclosure from FIG. 2.

FIGS. 5 and 6 show the second exemplary embodiment of the pressure-maintaining valve arrangement according to the disclosure according to FIG. 2 in two different longitudinal sections, wherein only the differences over the first exemplary embodiment according to FIGS. 3 and 4 are explained below.

In the second exemplary embodiment, the control pressure chamber 28 is not connected switchably, but rather permanently to the pressure at the inlet 30 of the pressure-maintaining valve 109. FIG. 5 shows in this regard that the piston collar 154 of the valve body 124 of the pressure-maintaining valve 109 is provided with longitudinal notches 194 via which the inner inlet pressure chamber 58 of the pressure-maintaining valve 109 is permanently connected to the control pressures chamber 28.

In the region of the cover-side end side 70 of the valve body 124, a piston ring 196 is fastened to the valve body 124, said piston ring serving as a radial expansion of the valve body 124. Located between the piston ring 196 and the cover-side end side 70 of the valve body 124, on the one hand, and the cover 68, on the other hand, is the tank chamber 72 of the pressure-maintaining valve 109, which tank chamber has the connections, described with respect to FIGS. 3 and 4, to the tank chamber 80 of the pilot valve 122 and to the tank connection T of the pressure-maintaining valve 109.

A control pressure chamber 140 which, according to the disclosure, can be pressurized and can be relieved of pressure and to this extent is switchable is arranged on that side of the piston ring 196 which faces away from the cover 68, wherein an associated control surface 142 which is switchable according to the disclosure is arranged on the piston ring 196. Said control surface interacts with the spring 26 of the pressure-maintaining valve 109 in the closing direction of the valve body 124, and therefore the pressure-maintaining valve 109 is shut when the control pressure chamber 140 is connected to the inlet 88 of the pilot valve 122. For this purpose, the outlet 82 of the pilot valve 122 is connected to the control pressure chamber 140 via the radial channel portion 84 (mentioned with respect to FIG. 6) of the cover 68 and furthermore with a channel portion 198 formed in the screw-in cartridge 144.

In the two exemplary embodiments shown, on the one hand, according to FIGS. 3 and 4 and, on the other hand, according to FIGS. 5 and 6, the cover 68 with the recess for the screw-in cartridge of the pilot valve 22; 122 and with the tank channel 78 and with the radial channel portion 84 and with the second channel portion 92 is of identical design. The outer circumferences of the screw-in cartridge 44 of the first exemplary embodiment according to FIGS. 3 and 4 and of the screw-in cartridge 144 of the second exemplary embodiment according to FIGS. 5 and 6 are also identical, and therefore the two screw-in cartridges 44; 144 can be screwed into the same primary housing 46.

In a variant of the exemplary embodiment according to FIGS. 3 and 4, the piston collar 54 of the valve body 24 is formed with one or more longitudinal notches 194, as is shown in FIG. 5. The longitudinal notches constitute a nozzle between the inlet 30 and the control pressure chamber 28 of the pressure-maintaining valve 9. The pilot valve 22 is then designed as a 2/2-way directional control valve, or a 3/2-way directional control valve is used as a 2/2-way directional control valve which, in one switching position, relieves the control pressure chamber 28 to the tank and, in its second switching position, shuts off the control pressure chamber from the tank, and therefore the same pressure prevails there as in the inlet 30. The inlet channel with the channel portions 90 and 92 is not present.

A pressure-maintaining valve arrangement of a purge circuit of a closed hydraulic circuit is disclosed, the pressure-maintaining valve of which can be shut off via a pilot valve. In a first variant, a control pressure chamber, acting in the closing direction, of the pressure-maintaining valve can be relieved via the pilot valve to a tank, and therefore the pressure-maintaining valve is closed via a spring acting in the closing direction. In a second variant, an additional control pressure chamber acting in the closing direction is provided which can be loaded via the pilot valve, and therefore the pressure-maintaining valve closes. For this purpose, use is made of the pressure of the inlet of the pressure-maintaining valve.

LIST OF REFERENCE SIGNS

1 Variable displacement pump
2 Working line
4 Synchroniz
6 Purge valve ing cylinder
8 Purge line
9; 109 Pressure-maintaining valve
10 Feed pump
12 Feed line
14 Feed line portion
16 Feed line portion
18 Pressure-limiting valve
20 Nonreturn valve
21 Control line
22; 122 Pilot valve
24; 124 Valve body of the pressure-maintaining valve
26 Spring of the pressure-maintaining valve
28 Control pressure chamber
30 Inlet of the pressure-maintaining valve
32 Spring of the pilot valve
34 Actuator
36 Tank connection of the pilot valve
38 Nozzle
140 Control pressure chamber
42; 142 Control surface
44; 144 Screw-in cartridge
46 Primary housing
48 Spring plate
50 Conical closing portion
52 Valve seat
54; 154 Piston collar
56 Neck
58 Inner inlet pressure chamber
60 Radial bore
62 Outer inlet pressure chamber
64 First end side
66 Second end side
68 Cover
70 Cover-side end side
72 Tank chamber of the pressure-maintaining valve
74 Through channel
76 Through channel
77 Nozzle
78 Tank channel
80 Tank chamber of the pilot valve
82 Outlet of the pilot valve
84 Radial channel portion
86 Oblique channel portion
88 Inlet of the pilot valve
90 First channel portion
92 Second channel portion
194 Longitudinal notch
196 Piston ring
198 Channel portion
T Tank/tank connection of the pressure-maintaining valve

What is claimed is:

1. A pressure-maintaining valve arrangement for a purge circuit of a closed hydraulic circuit, comprising:

a pilot valve including a valve body and an inlet of the pilot valve;

a pressure-maintaining valve including a valve housing and a valve body located at least partially within the valve housing, the valve housing of the pressure-maintaining valve defining an inlet of the pressure-maintaining valve, and the valve body of the pressure-maintaining valve defining a nozzle located downstream of the inlet of the pressure-maintaining valve, the nozzle configured to receive an inlet pressure from the inlet of the pressure-maintaining valve and to output a nozzle pressure downstream of the nozzle, the valve body of the pressure-maintaining valve configured to be acted upon in a closing direction by a force of a spring and in an opening direction by the nozzle pressure, wherein the inlet pressure from the inlet of the pressure-maintaining valve is upstream of the nozzle, wherein a first channel portion of an inlet channel extends directly from the inlet of the pressure-maintaining valve to the inlet of the pilot valve to connect directly the inlet of the pilot valve to the inlet pressure from the pressure-maintaining valve, wherein inlet of the pilot valve is upstream of the nozzle, wherein the valve body of the pressure-maintaining valve defines an inner inlet pressure chamber that is downstream of the nozzle, wherein a control surface on the valve body of the pressure-maintaining valve is located in a control pressure chamber that is spaced apart from the inner inlet pressure chamber, wherein the control surface is acted upon by the inlet pressure of the pressure-maintaining valve in a first position of the valve body of the pilot valve, and wherein the control pressure chamber is relieved to a tank connection of the pressure-maintaining valve in a second position of the valve body of the pilot valve.

2. The pressure-maintaining valve arrangement according to claim 1, wherein:

a valve housing of the pilot valve is configured as a screw-in cartridge that is screwed into a cover to which the pilot valve is fastened, the inlet of the pilot valve is arranged on an outer circumference of the screw-in cartridge of the pilot valve, and an outlet of the pilot valve is arranged on a distal end side of the screw-in cartridge of the pilot valve, the distal end side of the screw-in cartridge of the pilot valve inserted or introduced into the cover.

3. The pressure-maintaining valve arrangement according to claim 2, wherein:

an outer inlet pressure chamber is arranged on the outer circumference of the screw-in cartridge of the pressure-maintaining valve and is connected via the first channel portion to the inlet of the pilot valve, the first channel portion is arranged in the screw-in cartridge of the pressure-maintaining valve, a second channel portion of the inlet channel is arranged in the cover, and the outer inlet pressure chamber is upstream of the nozzle.

4. The pressure-maintaining valve arrangement according to claim 1, wherein:

the pilot valve is fastened to a cover, and a tank pressure chamber of the pressure-maintaining valve is arranged between a cover-side end side of the valve body of the pressure-maintaining valve and the cover and is connected to a tank connection of the pilot valve.

5. The pressure-maintaining valve arrangement according to claim 4, wherein:

the tank connection of the pilot valve is connected to the tank pressure chamber of the pressure-maintaining valve via a tank pressure chamber of the pilot valve, and the tank pressure chamber is formed on the outer circumference of the screw-in cartridge of the pilot valve and in the cover, and via a tank channel of the cover.

6. The pressure-maintaining valve arrangement according to claim 4, wherein the valve body of the pressure-maintaining valve is penetrated by a through channel which connects the tank connection of the pressure-maintaining valve to the tank pressure chamber of the pressure-maintaining valve.

7. The pressure-maintaining valve arrangement according to claim 4, wherein:

the tank pressure chamber of the pressure-maintaining valve is bounded by a piston ring, and the control surface is arranged on a side of the piston ring opposite the tank pressure chamber.

8. The pressure-maintaining valve arrangement according to claim 1, wherein:

the spring of the pressure-maintaining valve is tensioned via a spring plate against a tank-connection-side end side of the valve body of the pressure-maintaining valve, the spring plate is penetrated by a through channel that forms a nozzle fluidically connected to the tank connection, and the spring plate is movable relative to the valve housing of the pressure-maintaining valve.

9. The pressure-maintaining valve arrangement according to claim 1, wherein a piston collar is formed on the valve body of the pressure-maintaining valve, via which the piston collar of the valve body is guided in a valve bore of the pressure-maintaining valve.

10. The pressure-maintaining valve arrangement according to claim 9, wherein:

the valve body of the pressure-maintaining valve has a closing portion that is configured to be tensioned into a valve seat of the pressure-maintaining valve, and a neck forms the inner inlet pressure chamber of the pressure-maintaining valve and the neck is located between the closing portion and the piston collar.

11. The pressure-maintaining valve arrangement according to claim 1, wherein:

the control surface acts in the opening direction of the valve body of the pressure-maintaining valve, the first position of the valve body of the pilot valve brings about a normal function of the pressure-maintaining valve, the second position of the valve body of the pilot valve brings about a shut-off function of the pressure-maintaining valve, in the normal function the pressure-maintaining valve is configured to maintain a pressure in the purge circuit, and in the shut-off function the pressure-maintaining valve is configured to stop fluid flow in the purge circuit.

12. The pressure-maintaining valve arrangement according to claim 11, further comprising:

a spring of the pilot valve, via which the valve body of the pilot valve is pretensioned into the first position, and an actuator via which the valve body of the pilot valve is movable into the second position.

13. The pressure-maintaining valve arrangement according to claim 1, wherein:

the control surface acts in the closing direction of the valve body of the pressure-maintaining valve, the first position of the valve body of the pilot valve brings about a shut-off function of the pressure-maintaining valve, the second position of the valve body of the pilot valve brings about a normal function of the pressure-maintaining valve, in the normal function the pressure-maintaining valve is configured to maintain a pressure in the purge circuit, and in the shut-off function the pressure-maintaining valve is configured to stop fluid flow in the purge circuit.

14. The pressure-maintaining valve arrangement according to claim 13, further comprising:

a spring of the pilot valve, via which the valve body of the pilot valve is pretensioned into the second position, and an actuator via which the valve body of the pilot valve is movable into the first position.

* * * * *